US008870529B2

(12) United States Patent
Casavant et al.

(10) Patent No.: US 8,870,529 B2
(45) Date of Patent: Oct. 28, 2014

(54) METHODS AND APPARATUS TO FACILITATE TURBINE CASING ASSEMBLY

(75) Inventors: Matthew Stephen Casavant, Greenville, SC (US); Bradley Edwin Wilson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 581 days.

(21) Appl. No.: 13/208,829

(22) Filed: Aug. 12, 2011

(65) Prior Publication Data

US 2013/0039749 A1 Feb. 14, 2013

(51) Int. Cl.
*F01D 25/26* (2006.01)
*F01D 25/24* (2006.01)

(52) U.S. Cl.
CPC ..... *F01D 25/243* (2013.01)
USPC ..... 415/126; 415/134

(58) Field of Classification Search
CPC ..... F01D 25/24; F01D 25/26; F01D 25/28; F01D 25/243; F01D 25/246
USPC ..... 415/108, 182.1, 201, 213.1, 214.1, 126
See application file for complete search history.

(56) References Cited

U.S. PATENT DOCUMENTS

| | | | | |
|---|---|---|---|---|
| 1,067,356 | A * | 7/1913 | Ljungstrom | 415/136 |
| 3,628,884 | A * | 12/1971 | Mierley, Sr. | 415/213.1 |
| 4,112,582 | A * | 9/1978 | Beckershoff | 33/655 |
| 5,088,279 | A * | 2/1992 | MacGee | 60/226.1 |
| 5,934,684 | A * | 8/1999 | Brandon et al. | 277/421 |
| 6,402,468 | B1 | 6/2002 | Florin et al. | |
| 7,419,355 | B2 | 9/2008 | Burdgick | |
| 7,520,721 | B2 | 4/2009 | Hamlin et al. | |
| 7,581,922 | B1 * | 9/2009 | Morimoto et al. | 415/126 |
| 2009/0232651 | A1 * | 9/2009 | Ballard et al. | 415/220 |
| 2012/0114470 | A1 * | 5/2012 | Burdgick | 415/201 |

* cited by examiner

*Primary Examiner* — Ned Landrum
*Assistant Examiner* — Kayla McCaffrey
(74) *Attorney, Agent, or Firm* — Armstrong Teasdale LLP

(57) ABSTRACT

A turbine assembly is provided. The turbine assembly includes an inner turbine casing and an outer turbine casing radially outward from the inner turbine casing, the outer turbine casing including an aperture extending therethrough and a support assembly extending through the aperture, the support assembly externally adjustable outside of the outer turbine casing to adjust the inner turbine casing relative to the outer turbine casing.

20 Claims, 7 Drawing Sheets

METHODS AND APPARATUS TO FACILITATE TURBINE CASING ASSEMBLY

BACKGROUND OF THE INVENTION

The present invention relates generally to turbine engine assemblies, and more particularly, to support assemblies that facilitate adjusting turbine engine assemblies.

At least some known industrial turbines, such as gas and/or steam turbines, include an inner casing mounted to an outer casing. Adjustment of the inner turbine casing relative to the outer turbine casing facilitates aligning the inner casing with respect to internal rotating components, reducing clearances and increasing an operating efficiency of the turbine and reducing engine to engine variation. However, given the weight and size of at least some known inner and outer turbine casing, adjusting and/or aligning the components with respect to one another during maintenance procedures, for example, may be time-consuming, difficult, and expensive.

To facilitate assembly of turbine casings, at least some known adjustment systems are used. At least some of such known turbine adjustment systems are located entirely within the outer turbine casing. However, although convenient, such turbine adjustment systems are not externally adjustable. Accordingly, to adjust the inner and outer turbine casing relative to each other, the outer turbine casing must first be disassembled to gain access to the adjustment system. Further, in at least some known adjustment systems, the final adjustment must be performed with an upper half of the outer turbine casing removed. However, mounting the upper half of the outer turbine casing after final adjustment may itself offset and/or alter the adjustment. Similarly, if the turbine adjustment system malfunctions or is damaged, the outer turbine casing must first be disassembled before beginning any repair and/or replacement of the turbine adjustment system. Accordingly, the benefits of such adjustment systems may be limited.

BRIEF DESCRIPTION OF THE INVENTION

In one aspect, a turbine assembly is provided. The turbine assembly includes an inner turbine casing and an outer turbine casing radially outward from the inner turbine casing, the outer turbine casing comprising an aperture extending therethrough and a support assembly extending through the aperture, the support assembly externally adjustable outside of the outer turbine casing to adjust the inner turbine casing relative to the outer turbine casing.

In another aspect, an adjustment system for adjusting a turbine assembly is provided. The adjustment system includes a wedge configured to support a substantially horizontal surface of an inner turbine casing, a ledge comprising a surface that is inclined with respect to the substantially horizontal surface, the ledge configured to be coupled to an outer turbine casing that is radially outward from the inner turbine casing, the wedge is slidably coupled to the ledge inclined surface. The adjustment system further includes a rod coupled to the wedge and a plate threadably coupled to the rod for selectively moving the wedge across the ledge inclined surface when the plate is rotated about the rod.

In yet another aspect, a method of assembling a turbine casing assembly is provided. The method includes providing an inner turbine casing including a substantially horizontal surface, providing an outer turbine casing including an aperture defined therethrough, wherein the outer turbine casing is radially outward from the inner turbine casing, and coupling a support assembly to the outer turbine casing such that the support assembly extends through the aperture defined in the outer turbine casing and supports the substantially horizontal surface of the inner turbine casing.

DETAILED DESCRIPTION OF THE INVENTION

The methods and apparatus described herein facilitate adjustment of a turbine casing assembly. Specifically, an externally adjustable support assembly is provided that facilitates adjustment of an inner turbine casing with respect to an outer turbine casing and alignment of the inner turbine casing with respect to internal components, such as a rotor. Moreover, the support assembly described herein also facilitates adjusting a turbine casing assembly without requiring an outer turbine casing to be disassembled prior to adjustment. Furthermore, the methods and apparatus described herein facilitate reducing repair and replacement costs associated with turbine adjustment systems.

Figure 1:
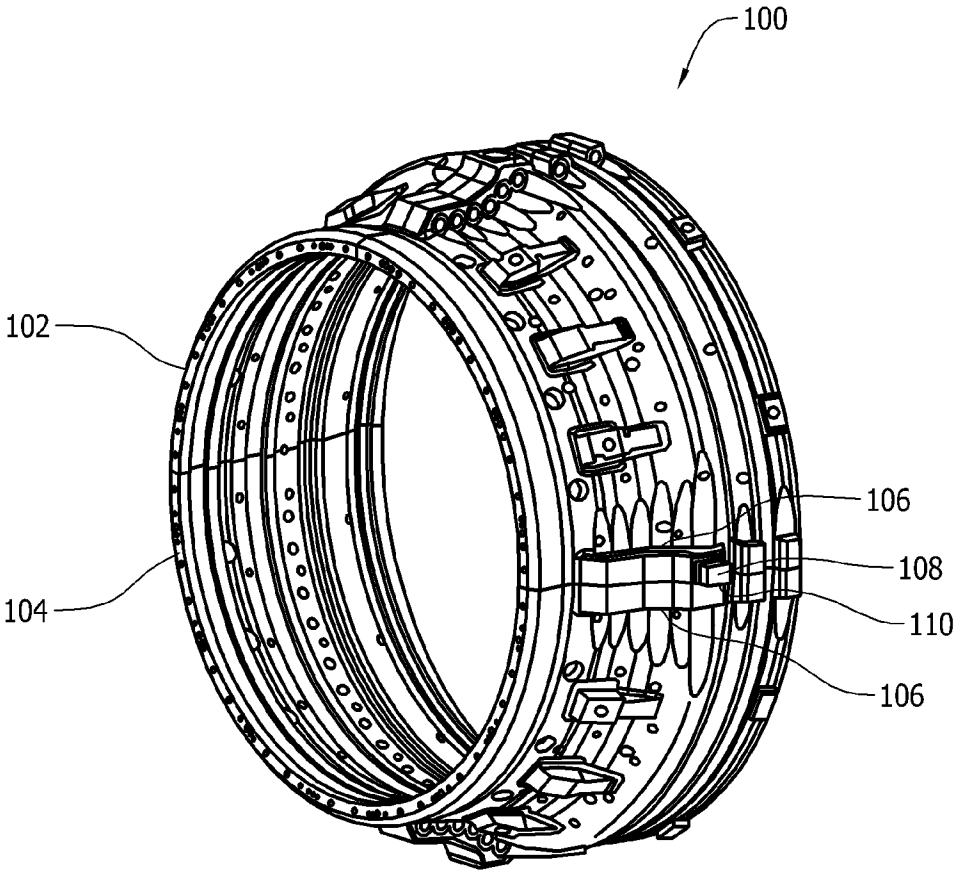
FIG. 1 is a perspective view of an exemplary inner turbine casing.

FIG. 1 is a perspective view of an exemplary inner turbine casing 100. In the exemplary embodiment, inner turbine casing 100 includes an upper half 102 and a lower half 104. Alternatively, inner turbine casing 100 may be unitarily formed. To assemble inner turbine casing 100, bolts (not shown) or any other suitable fasteners are inserted through apertures 106 defined in upper and lower halves 102 and 104. Specifically, the bolts couple upper and lower halves 102 and 104 together. Inner turbine casing 100 includes a plurality of support arms 108 that facilitate adjusting inner turbine casing 100 with respect to an outer turbine casing (not shown in FIG. 1). More specifically, in the exemplary embodiment, inner turbine casing 100 includes two support arms 108. Alternatively, inner turbine casing 100 may include any number of support arms 108 that enables inner turbine casing 100 to function as described herein. Each support arm 108 defines a substantially horizontal surface 110 on inner turbine casing 100. Internal components (not shown), such as rotor blades, stator vanes, nozzles, shrouds, and/or buckets, operate within inner turbine casing 100. Adjusting inner turbine casing 100, as described in detail below, facilitates reducing clearances between inner turbine casing 100 and internal components, increasing an operating efficiency of the turbine and reducing engine to engine variation.

Figure 2:
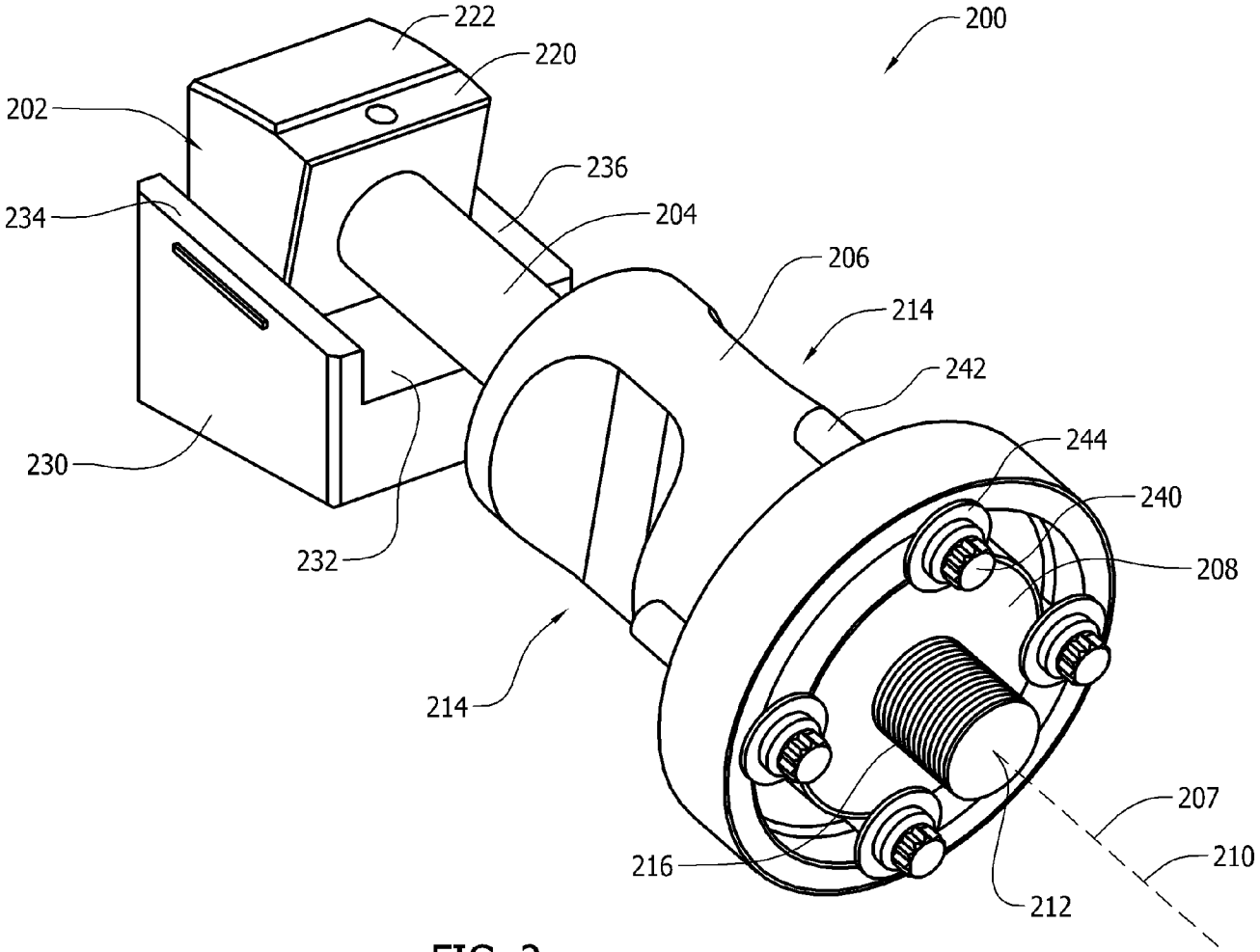
FIG. 2 is a perspective view of an exemplary support assembly that may be used to support the inner turbine casing shown in FIG. 1.

FIG. 2 is a perspective view of an exemplary support assembly 200 that may be used to adjust inner turbine casing 100 with respect to an outer turbine casing (not shown in FIG. 2). In the exemplary embodiment, support assembly 200 includes a wedge 202, a rod 204, a bushing 206, and a lock plate 208. A longitudinal axis 210 of support assembly 200 extends through a center 212 of rod 204.

In the exemplary embodiment, bushing 206 is substantially cylindrical and includes at least two recesses 214 defined therein. Recesses 214 enable a rotational position of bushing 206 to be secured with respect to an outer turbine casing (not shown in FIG. 2), as described in detail below. Alternatively, bushing 206 may not include recesses 214. In the exemplary embodiment, bushing 206 includes a rod aperture 207 defined therethrough. Rod 204 extends through aperture 207 to slidably engage bushing 206. Lock plate 208 threadably engages a threaded end 216 of rod 204. To adjust support assembly 200, lock plate 208 is rotated about longitudinal axis 210, as described in more detail below. Lock plate 208 can be rotated using, for example, a spanner wrench and/or any other suitable powered and/or unpowered tool.

Wedge 202 includes a wedge block 220 and a shim 222. In the exemplary embodiment, rod 204 is press-fit and/or doweled into wedge block 220. Alternatively, rod 204 may be coupled to wedge block 220 using any coupling means that enables support assembly 200 to function as described herein. Shim 222 contacts support arm 108 and/or substantially horizontal surface 110 and supports inner turbine casing 100, as described in detail below. Shim 222 may include a thin piece of material and/or a coating that forms a wear interface on wedge block 220.

Wedge 202 slidably engages a ledge 230 that includes a surface 232 that is inclined with respect to substantially horizontal surface 110 of inner turbine casing 100. In the exemplary embodiment, ledge 230 includes a first retaining flange 234 and a second retaining flange 236 that each receive and position wedge 202 relative to inclined surface 232. Alternatively, ledge 230 may not include first and second retaining flanges 234 and 236. Moreover, in the exemplary embodiment, inclined surface 232 is substantially parallel to longitudinal axis 210.

Support assembly 200 includes a plurality of fastening devices 240 that are used to secure support assembly 200 to an outer turbine casing (not shown in FIG. 2). Moreover, fastening devices 240 are used to secure lock plate 208 with respect to bushing 206. In the exemplary embodiment, each fastening device 240 includes a bolt 242 and a washer 244. Alternatively, fastening device 240 may include any other fastening mechanism that enables support assembly 200 to function as described herein.

Figure 3:
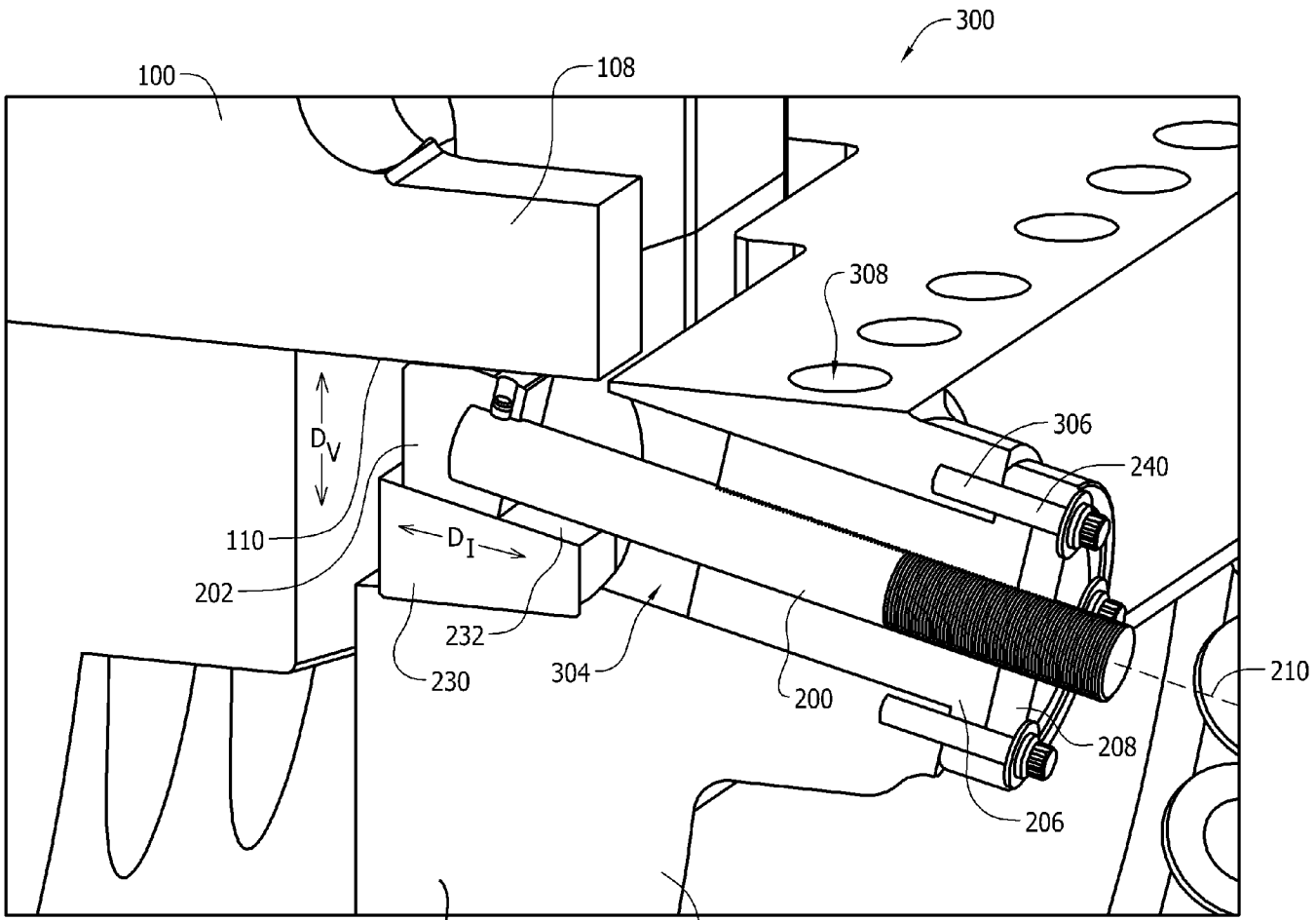
FIG. 3 is a perspective cut-away view of an exemplary turbine casing assembly that may be used with the support assembly shown in FIG. 2.

FIG. 3 is a perspective cut-away view of a portion of an exemplary turbine casing assembly 300. In the exemplary embodiment, turbine casing assembly 300 includes inner turbine casing 100 and an outer turbine casing 302 radially outward of inner turbine casing 100 that extends to substantially circumscribe inner turbine casing 100. For clarity, in the embodiment shown in FIG. 3, only a lower half 303 of outer turbine casing 302 is shown. Outer turbine casing 302 includes at least one aperture 304 defined therethrough. Each aperture 304 is sized and oriented to receive support assembly 200 therein. To secure support assembly 200 to outer turbine casing 302, fastening devices 240 are inserted through bushing 206 and into fastening apertures 306 defined within outer turbine casing 302. Further, when fastening devices 240 are secured in place, lock plate 208 is secured with respect to bushing 206 along longitudinal axis 210.

In the exemplary embodiment, lower half 303 of outer turbine casing 302 includes at least one coupling aperture 308 defined therethrough for coupling an upper half (not shown in FIG. 3) of outer turbine casing 302 to lower half 303. Further, in one embodiment, when bushing 206 is secured to outer turbine casing 302, at least one recess 214 is substantially aligned with respect to coupling aperture 308. Accordingly, when a suitable fastening device, such as a bolt and/or pin, is inserted into coupling aperture 308 to couple the upper half to lower half 303, the rotational position of bushing 206 is secured with respect to outer turbine casing 302. In the exemplary embodiment, bushing 206 is a separate component from outer turbine casing 302. In such an embodiment, all of support assembly 200 can be inserted through aperture 304 when installing support assembly 200 in turbine casing assembly 300. Alternatively, bushing 206 may be formed integrally with outer turbine casing 302. Further, in some embodiments, depending on a spacing of coupling apertures 308, coupling apertures 308 do not align with bushing 206 and/or recess 214.

During assembly, wedge 202 contacts substantially horizontal surface 110 of inner turbine casing 100. More specifically, wedge 202 contacts a support arm 108 of inner turbine casing 100. As wedge 202 is slidably forced along inclined surface 232 in a direction $D_I$, inner turbine casing 100 is moved in a substantially vertical direction $D_V$. Accordingly, support assembly 200 can be adjusted to selectively change a position of inner turbine casing 100 relative to outer turbine casing 302. In the exemplary embodiment, ledge 230 is a separate component coupled to outer turbine casing 302. Alternatively, ledge 230 may be formed integrally with outer turbine casing 302.

To adjust a position of support assembly 200, lock plate 208 is rotated about longitudinal axis 210. Lock plate 208 can be rotated using, for example, a spanner wrench and/or any other suitable powered and/or unpowered tool. Because fastening devices 240 secure lock plate 208 in position with respect to bushing 206 along longitudinal axis 210, when lock plate 208 is rotated, lock plate 208 does not move in direction $D_I$. Rather, because lock plate 208 is threadably coupled with rod 204, when lock plate 208 is rotated, rod 204 and wedge 202 are moved in direction $D_I$. More specifically, as lock plate 208 is rotated, rod 204 slides in direction $D_I$ with respect to bushing 206. As such, when lock plate 208 is rotated in a first direction, inner turbine casing 100 is elevated with respect to outer turbine casing 302, and when lock plate 208 is rotated in a second direction that is opposite to the first direction, inner turbine casing 100 is lowered with respect to outer turbine casing 302.

Notably, support assembly 200 can be adjusted externally from turbine casing assembly 300 such that casing assembly 300 does not need to be disassembled to adjust inner turbine casing 100 with respect to outer turbine casing 302. Further, if support assembly 200 malfunctions or is damaged, outer turbine casing 302 does not need to be disassembled. Rather, in such an instance, fastening devices 240 can be removed from fastening apertures 306 to enable support assembly 200 to be removed from aperture 304. Further, in the event of extensive damage to support assembly 200 and/or turbine casing assembly 300, a cutting torch or similar tool may be used to cut through fastening devices 240 to enable at least a portion of support assembly 200 to be removed from within turbine casing assembly 300.

Figure 4:
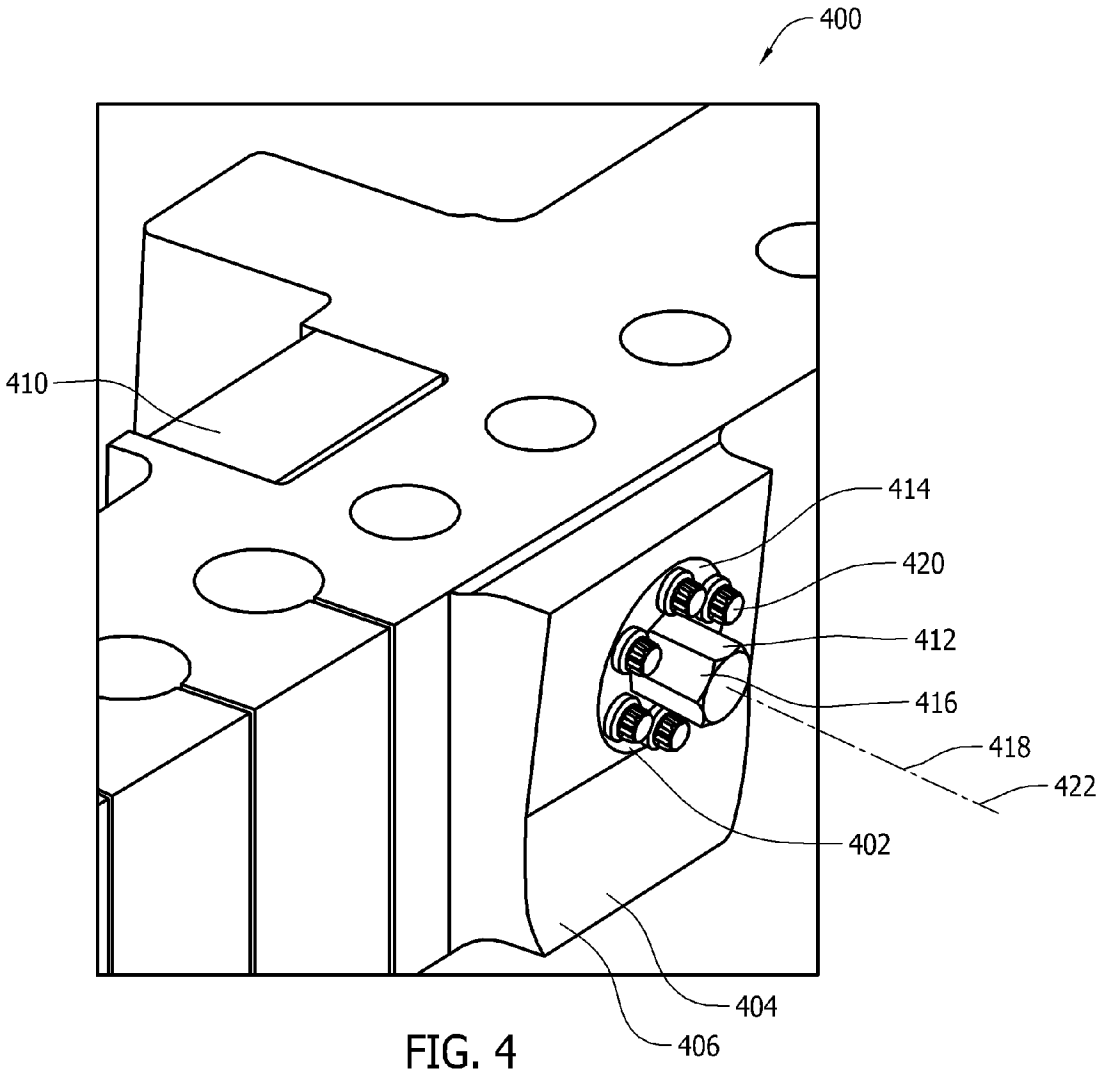
FIG. 4 is a perspective view of an alternate turbine casing assembly.
Figure 5:
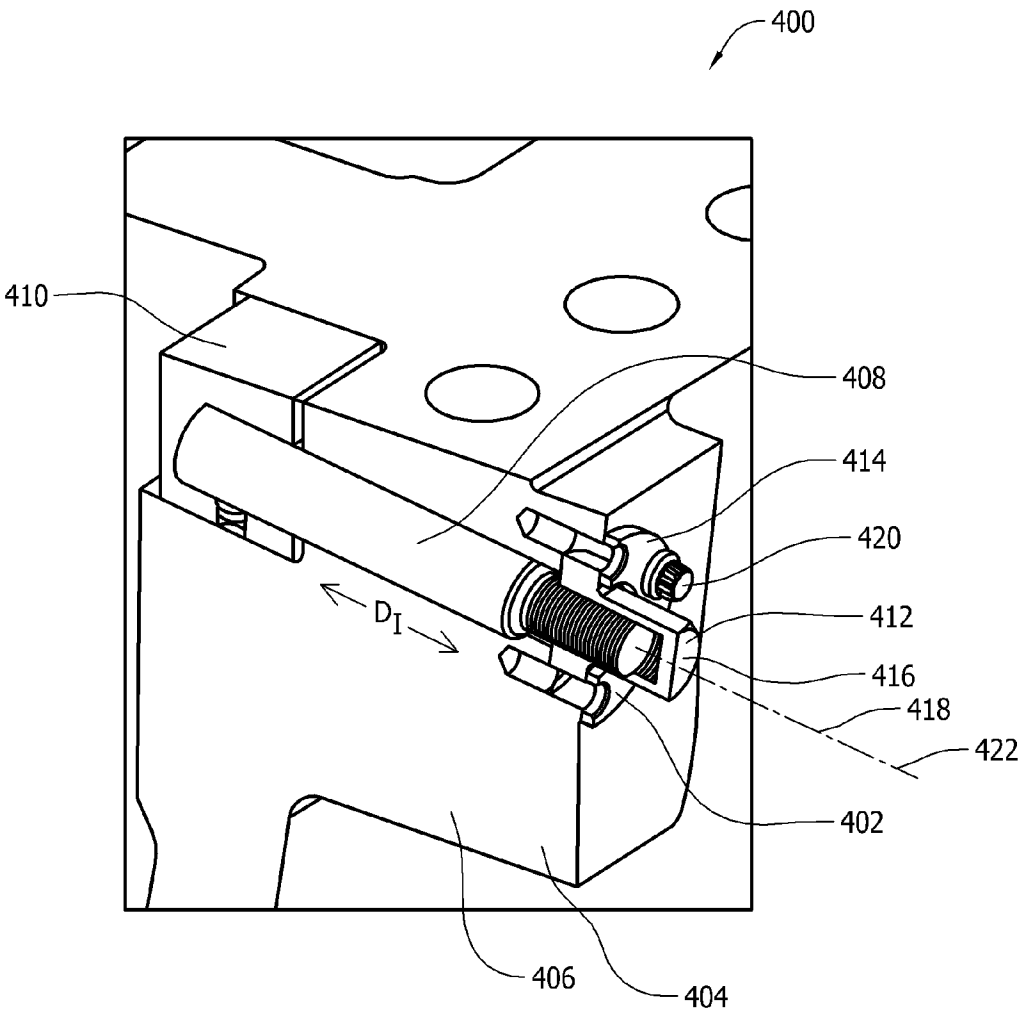
FIG. 5 is a perspective cut-away view of the turbine casing assembly shown in FIG. 4.

FIG. 4 is a perspective view of an alternate turbine casing assembly 400. FIG. 5 is a perspective cut-away view of turbine casing assembly 400. Turbine casing assembly 400 includes a support assembly 402 extending through a lower half 404 of an outer turbine casing 406. Similar to support assembly 200 (shown in FIG. 2), support assembly 402 includes a rod 408 and a wedge 410. Support assembly 402 also includes an adjustment nut 412 threadably coupled to rod 408 and a retainer plate 414 that secures adjustment nut 412 with respect to lower half 404. A head 416 of adjustment nut 412 extends through an aperture 418 defined through retainer plate 414.

A plurality of fastening devices 420 secure support assembly 402 to outer turbine casing 406, similar to fastening devices 240 (shown in FIG. 2). Moreover, fastening devices 420 secure adjustment nut 412 with respect to outer turbine casing 406. To adjust a position of support assembly 402, adjustment nut 412 is rotated about a longitudinal axis 422 of support assembly 402, similar to rotating lock plate 208 about longitudinal axis 210 (both shown in FIGS. 2 and 3). To facilitate rotation of adjustment nut 412, head 416 is shaped to mate with a suitable rotation tool. In the exemplary embodiment, head 416 forms a hexagonal nut that mates with a corresponding wrench. Alternatively, head 416 may be shaped to mate with any other suitable powered and/or unpowered tool.

Support assembly 402 operates substantially similar to support assembly 200 (shown in FIGS. 2 and 3). More specifically, because fastening devices 420 secure adjustment nut 412 in position with respect to outer turbine casing 406 along longitudinal axis 422, when adjustment nut 412 is rotated, rod 408 and wedge 410 slide in direction $D_I$ with respect to outer turbine casing 406. Accordingly, similar to support assembly 200 (shown in FIGS. 2 and 3), support assembly 402 is externally adjustable.

Figure 6:
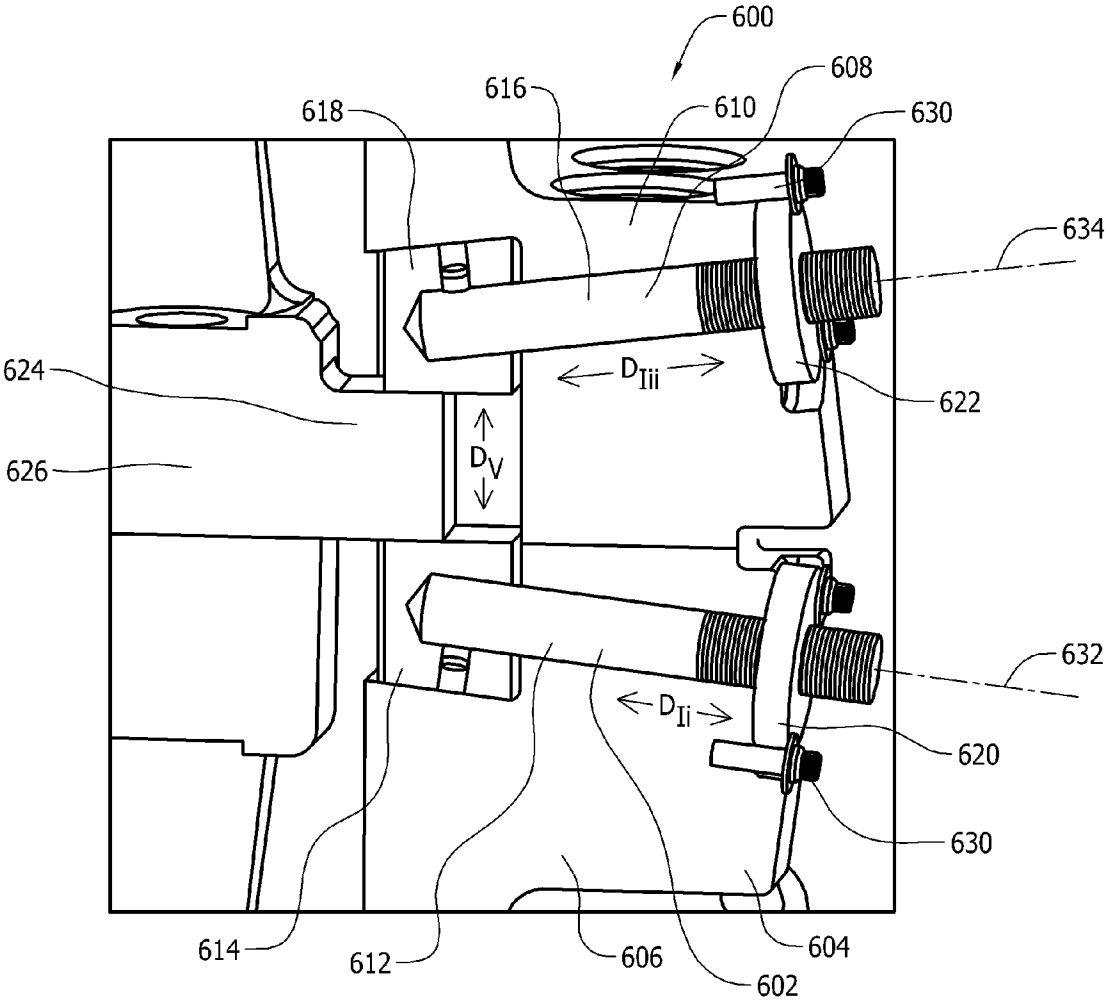
FIG. 6 is a perspective cut-away view of an alternate turbine casing assembly.

FIG. 6 is a perspective cut-away view of an alternate turbine casing assembly 600. Turbine casing assembly 600 includes a first support assembly 602 extending through a lower half 604 of an outer turbine casing 606 and a second support assembly 608 extending through an upper half 610 of outer turbine casing 606.

Similar to support assembly 200 (shown in FIG. 2), first support assembly 602 and includes a first rod 612 and a first wedge 614, and second support assembly 608 includes a second rod 616 and a second wedge 618. First support assembly 602 includes a first lock plate 620 threadably coupled to first rod 612 and second support assembly 608 includes a second lock plate 622 threadably coupled to second rod 616. A support arm 624 similar to support arm 108 (shown in FIG. 3) of an inner turbine casing 626 is positioned between first wedge 614 and second wedge 618.

A plurality of fastening devices 630 secure first and second support assemblies 602 and 608 to outer turbine casing 606, similar to fastening devices 240 (shown in FIG. 2). Moreover, fastening devices 630 secure first and second lock plates 620 and 622 with respect to outer turbine casing 606. To adjust a position of first support assembly 602, first lock plate 620 is rotated about a longitudinal axis 632 of first support assembly 602, similar to rotating lock plate 208 about longitudinal axis 210 (both shown in FIGS. 2 and 3). Similarly, to adjust a position of second support assembly 608, second lock plate 622 is rotated about a longitudinal axis 634 of second support assembly 608. First and second lock plates 620 and 622 can be rotated using, for example, a spanner wrench and/or any other suitable powered and/or unpowered tool.

First and second support assemblies 602 and 608 operate substantially similar to support assembly 200 (shown in FIGS. 2 and 3). More specifically, because fastening devices 630 secure first lock plate 620 in position with respect to lower half 604 along longitudinal axis 632, when first lock plate 620 is rotated, first rod 612 and first wedge 614 slide in a direction $D_{II}$ with respect to outer turbine casing 606. Similarly, because fastening devices 630 secure second lock plate 622 in position with respect to upper half 610 along longitudinal axis 634, when second lock plate 622 is rotated, second rod 616 and second wedge 618 slide in direction $D_{III}$ with respect to outer turbine casing 606. Accordingly, similar to support assembly 200 (shown in FIGS. 2 and 3), first and second support assemblies 602 and 608 are externally adjustable. Thus, first support assembly 602 and/or second support assembly 608 are adjustable to move inner turbine casing 626 in a substantially vertical direction $D_V$. Further, during operation, components inside turbine casing assembly 600, such as a rotor, may generate a torque that causes support arm 624 to lift up from first wedge 614. Accordingly, second support assembly 608 facilitates preventing inner turbine casing 626 from lifting up from first wedge 614.

Figure 7:
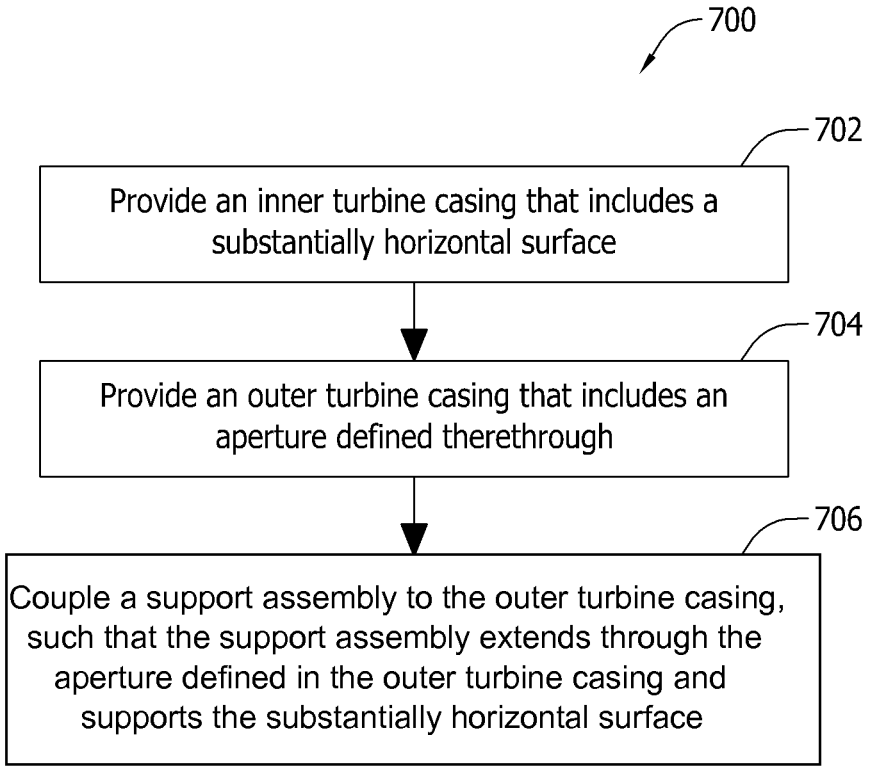
FIG. 7 is a flow chart of an exemplary method for that may be used for assembling the turbine casing assembly shown in FIG. 3.

FIG. 7 is a flow chart of an exemplary method 700 that may be used for assembling a turbine casing assembly such as turbine casing assembly 300. An inner turbine casing such as casing 100 is provided 702. The inner turbine casing includes a substantially horizontal surface such as surface 110. An outer turbine casing including an aperture defined therethrough is provided 704, such as outer turbine casing 302. The outer turbine casing is radially outward from the inner turbine casing. A support assembly such as support assembly 200 is coupled 706 to the outer turbine casing such that the support assembly extends through the aperture defined in the outer turbine casing. The support assembly supports the substantially horizontal surface of the inner turbine casing. The support assembly may include a wedge 202, rod 204, and lock plate 208 to facilitate adjusting the inner turbine casing with respect to the outer turbine casing.

The methods and apparatus described herein facilitate adjustment of a turbine casing assembly. Specifically, an externally adjustable support assembly is provided that facilitates adjustment of an inner turbine casing with respect to an outer turbine casing and alignment of the inner turbine casing with respect to internal components, such as a rotor. Moreover, the support assembly described herein also facilitates adjusting a turbine casing assembly without requiring an outer turbine casing to be disassembled prior to adjustment. Furthermore, the methods and apparatus described herein facilitate reducing repair and replacement costs associated with turbine adjustment systems.

Moreover, as compared to known adjustment systems, the methods and apparatus described herein facilitate decreasing the time and effort necessary to adjust a turbine casing assembly, because the present invention enables the external adjustment of a turbine casing assembly. Further, as compared to known adjustment systems, the support assembly described herein enables the inner turbine casing to be adjusted relative to the outer turbine casing to be aligned relative to internal components without disassembly. Moreover, because the support assembly is externally accessible unlike known adjustment systems, the support assembly described herein can be replaced and/or repaired more efficiently in the event of malfunction or damage to the support assembly and/or turbine casing assembly.

Exemplary embodiments of adjustment systems for turbine assemblies are described above in detail. The methods, apparatus, and systems are not limited to the specific embodiments described herein or to the specific illustrated support and turbine assemblies. While the invention has been described in terms of various specific embodiments, those skilled in the art will recognize that the invention can be practiced with modification within the spirit and scope of the claims.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbine assembly comprising:

an inner turbine casing comprising an upper half and a lower half that meets said upper half at a centerline of said inner turbine casing, said upper half comprising a substantially horizontal surface that is aligned with the centerline; and an outer turbine casing radially outward from said inner turbine casing, said outer turbine casing comprising an aperture extending therethrough and a support assembly extending through said aperture, said support assembly externally adjustable outside of said outer turbine casing to adjust said inner turbine casing relative to said outer turbine casing, wherein said support assembly supports said substantially horizontal surface at the centerline of said inner turbine casing.

2. A turbine assembly in accordance with claim 1, wherein said support assembly is selectively adjustable to elevate and lower said inner turbine casing relative to said outer turbine casing.

3. A turbine assembly in accordance with claim 1, wherein said support assembly comprises:

a ledge comprising a surface that is inclined with respect to said substantially horizontal surface;

a wedge slidably coupled to said ledge inclined surface;

a rod coupled to said wedge; and a plate threadably coupled to said rod, said wedge is movable across said ledge inclined surface as said plate is rotated about said rod.

4. A turbine assembly in accordance with claim 3, wherein said ledge is formed integrally with said outer turbine casing.

5. A turbine assembly in accordance with claim 3, wherein a longitudinal axis of said rod extends substantially parallel to said ledge inclined surface.

6. A turbine assembly in accordance with claim 3, further comprising a bushing for coupling said support assembly to said outer turbine casing, said bushing slidably coupled to said rod.

7. A turbine assembly in accordance with claim 3, wherein said plate comprises a head shaped and oriented to facilitate rotation of said plate using a tool.

8. An adjustment system for adjusting a turbine assembly, said adjustment system comprising:

a wedge configured to support a substantially horizontal surface of an inner turbine casing;

a ledge comprising a surface that is inclined with respect to the substantially horizontal surface, said ledge configured to be coupled to an outer turbine casing that is radially outward from the inner turbine casing, said wedge is slidably coupled to said ledge inclined surface;

a rod coupled to said wedge; and a plate threadably coupled to said rod for selectively moving said wedge across said ledge inclined surface when said plate is rotated about said rod.

9. An adjustment system in accordance with claim 8, wherein a longitudinal axis of said rod extends substantially parallel to said ledge inclined surface.

10. An adjustment system in accordance with claim 8, further comprising a bushing for coupling said adjustment system to the outer turbine casing, said bushing slidably coupled to said rod.

11. An adjustment system in accordance with claim 10, further comprising a plurality of fastening devices configured to secure said bushing to the outer turbine casing.

12. An adjustment system in accordance with claim 10, wherein said rod is configured to slide with respect to said bushing as said plate is rotated about said rod.

13. An adjustment system in accordance with claim 8, wherein said wedge is configured to support at least one support arm on the inner turbine casing.

14. An adjustment system in accordance with claim 8, wherein said plate comprises a head shaped and oriented to facilitate rotation of said plate using a tool.

15. A method of assembling a turbine casing assembly, said method comprising:

providing an inner turbine casing that includes an upper half and a lower half that meets the upper half at a centerline of the inner turbine casing, the upper half including a substantially horizontal surface that is aligned with the centerline;

providing an outer turbine casing including an aperture defined therethrough, wherein the outer turbine casing is radially outward from the inner turbine casing; and coupling a support assembly to the outer turbine casing such that the support assembly extends through the aperture defined in the outer turbine casing and supports the substantially horizontal surface at the centerline of the inner turbine casing.

16. A method in accordance with claim 15, further comprising:

adjusting the support assembly such that the inner turbine casing is adjusted relative to the outer turbine casing.

17. A method in accordance with claim 15, wherein coupling a support assembly comprises coupling a support assembly including a ledge including a surface that is inclined with respect to the substantially horizontal surface, a wedge slidably coupled to the ledge inclined surface, a rod coupled to the wedge, and a plate threadably coupled to the rod.

18. A method in accordance with claim 17, further comprising rotating the plate about the rod to cause the wedge to slide along the ledge inclined surface such that inner turbine casing is elevated relative to the outer turbine casing.

19. A method in accordance with claim 17, further comprising rotating the plate about the rod to cause the wedge to slide along the ledge inclined surface such that inner turbine casing is lowered relative to the outer turbine casing.

20. A method in accordance with claim 15, wherein providing an inner turbine casing comprises providing an inner turbine casing that includes at least one support arm having the substantially horizontal surface.

* * * * *